United States Patent [19]

Healey et al.

[11] 4,053,001

[45] Oct. 11, 1977

[54] METHOD FOR CHARGING A FIRE PROTECTION SYSTEM

[75] Inventors: William E. Healey; Morse R. Heineman, both of Bloomfield Hills; Ricky M. Erlich, Southfield; James H. Remaley, Livonia, all of Mich.

[73] Assignee: W. E. Healey & Associates, Inc., Bloomfield Hills, Mich.

[21] Appl. No.: 673,256

[22] Filed: Apr. 2, 1976

[51] Int. Cl.[2] ..... B65B 1/04; B65B 3/04

[52] U.S. Cl. ..... 141/2; 141/83; 141/231

[58] Field of Search ..... 141/1, 52, 83, 85, 89-92, 141/94, 231, 285, 290, 369, 372, 378, 2, 82; 248/130, 137, 141, 142, 154; 73/49.2, 49.8; 134/169 R, 171, 22 R; 137/238

[56] References Cited

U.S. PATENT DOCUMENTS

| | | | |
|---|---|---|---|
| 3,875,980 | 4/1975 | Getz | 141/83 |
| 3,951,185 | 4/1976 | Bower et al. | 141/1 R |

*Primary Examiner*—Houston S. Bell, Jr.
*Attorney, Agent, or Firm*—Cullen, Settle, Sloman & Cantor

[57] ABSTRACT

A method of charging or recharging one or more agent storage containers which may be located at suitable locations about a high value room or area which is to be protected from fire or explosions. Some of the agent storage containers may be placed in relatively inaccessible locations and one or more can be discharged in response to the detection of combustion to immediately suppress or extinguish the fire or deflagration-type rapid combustion. Each type of container must be properly charged with a relatively precise predetermined mass of fire extinguishing fluid agent, such as bromotrifluoromethane or the like, for effective operation. The method of the present invention eliminates or greatly reduces the time, expense and safety hazards involved in prior charging methods by no longer requiring that the agent storage container be removed from its location and placed on a scale during the charging operation.

In a first embodiment, a supply cylinder is coupled to an agent storage container to be charged and its initial weight is taken. The weight of the fluid agent corresponding to the predetermined mass which must be transferred is calculated and the calculated weight is subtracted from the initial weight to ascertain a desired weight. The supply cylinder remains on a weighing apparatus so that the reducing weight can be monitored as the agent is transferred from the cylinder to the container. When the desired weight is attained, transfer is terminated and the agent storage container is properly filled. The agent storage container may be superpressurized with nitrogen either before or after it is filled, to complete the charging operation.

Alternate methods include the use of one or more fluid transfer pumps to effect the transfer, the use of a pressurized inert gas in conjunction with or in lieu of the pumps for effecting transfer, methods employing the use of load cells for use with relatively large supply tanks and alternate hot weather and cold weather charging techniques wherein the heat exchange medium is external or internal to the supply tank.

39 Claims, 18 Drawing Figures

FIG. 5
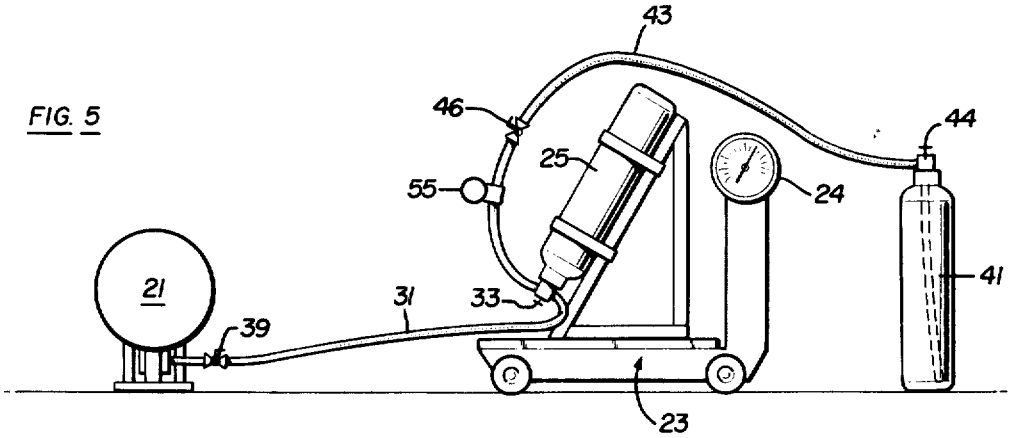
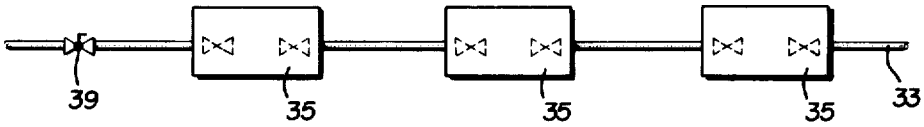
FIG. 6
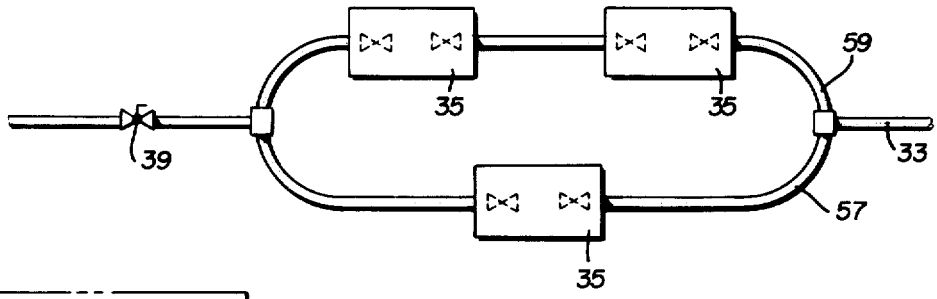
FIG. 7
FIG. 8
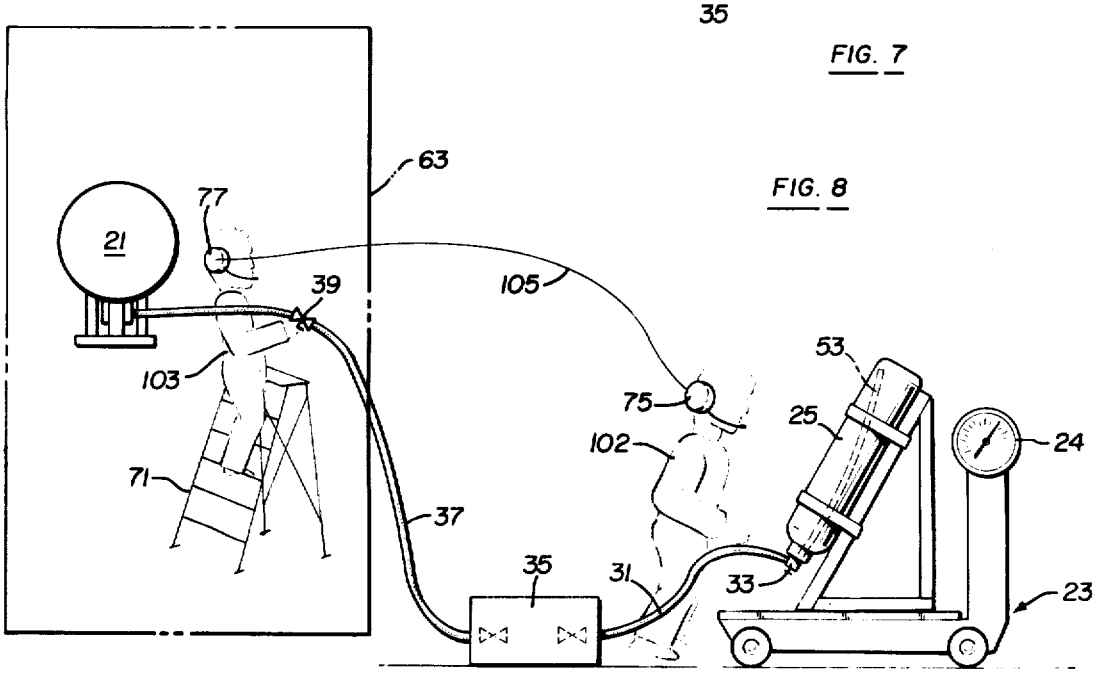

FIG. 9
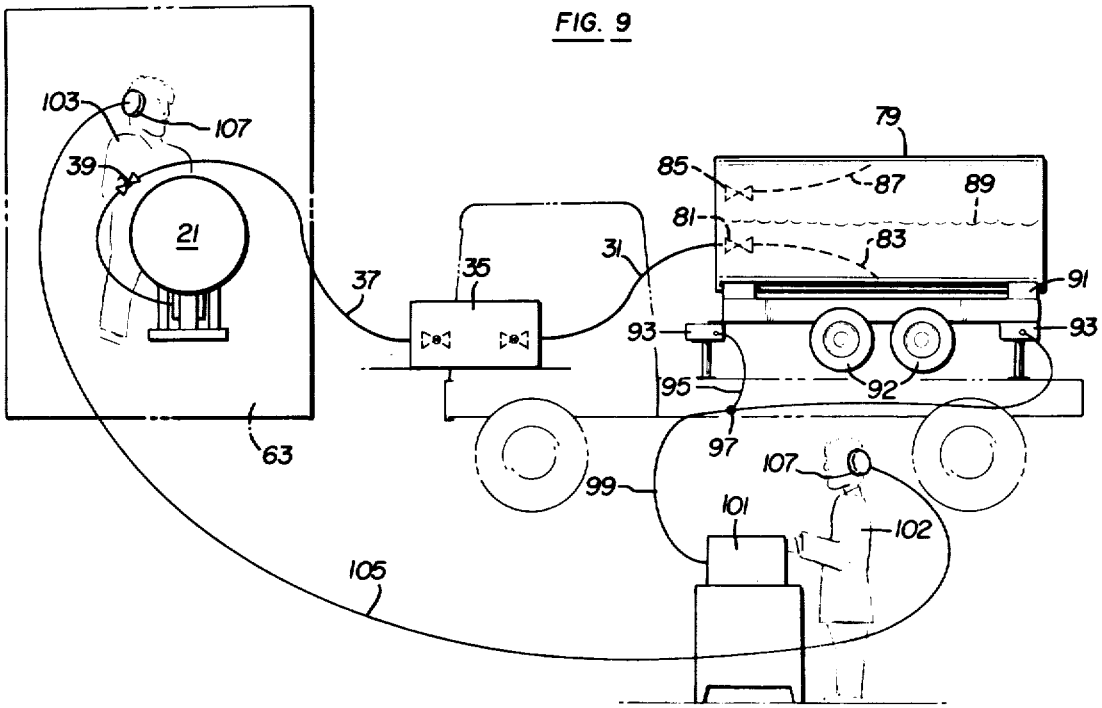
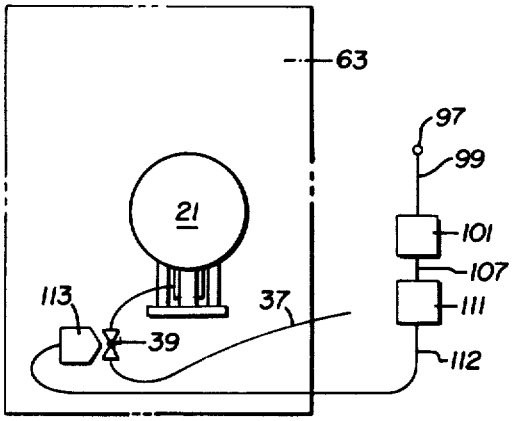
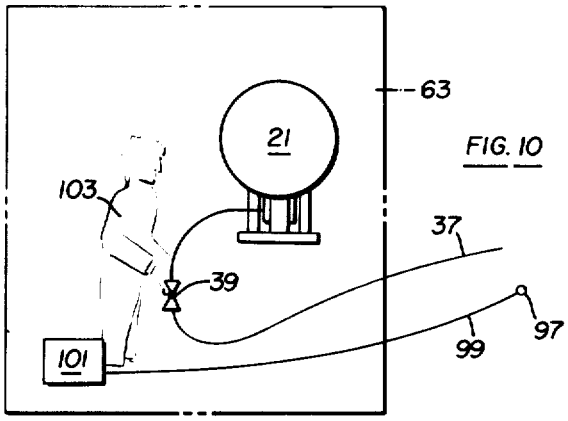
FIG. 10
FIG. 11
FIG. 12
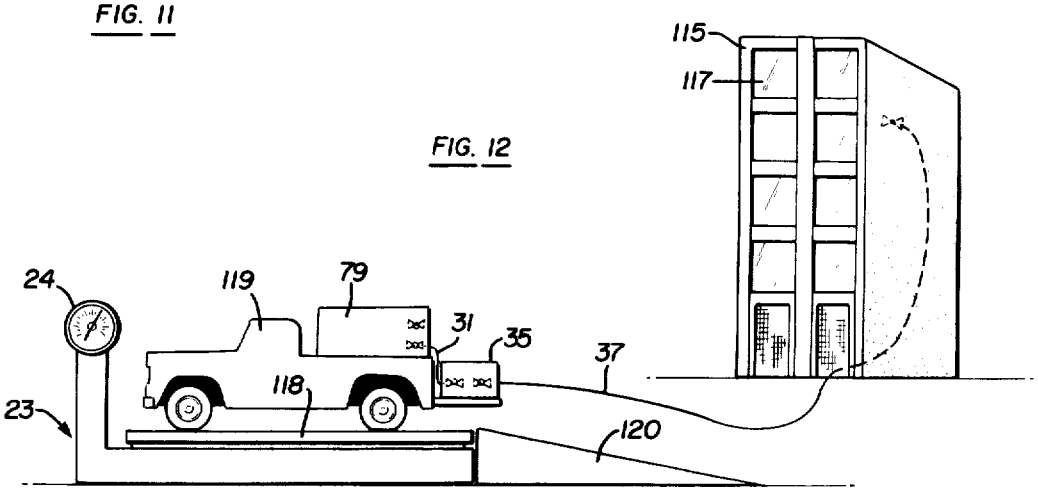

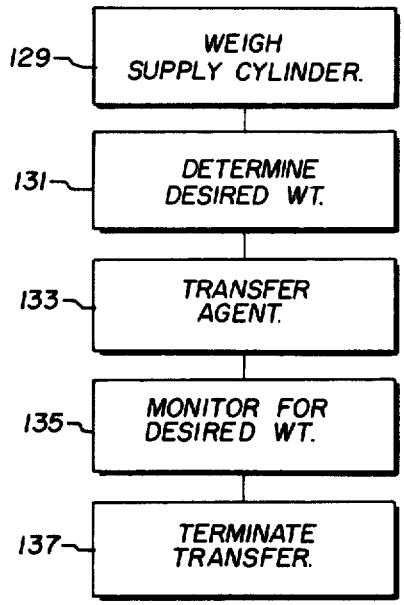
FIG. 13
FIG. 15
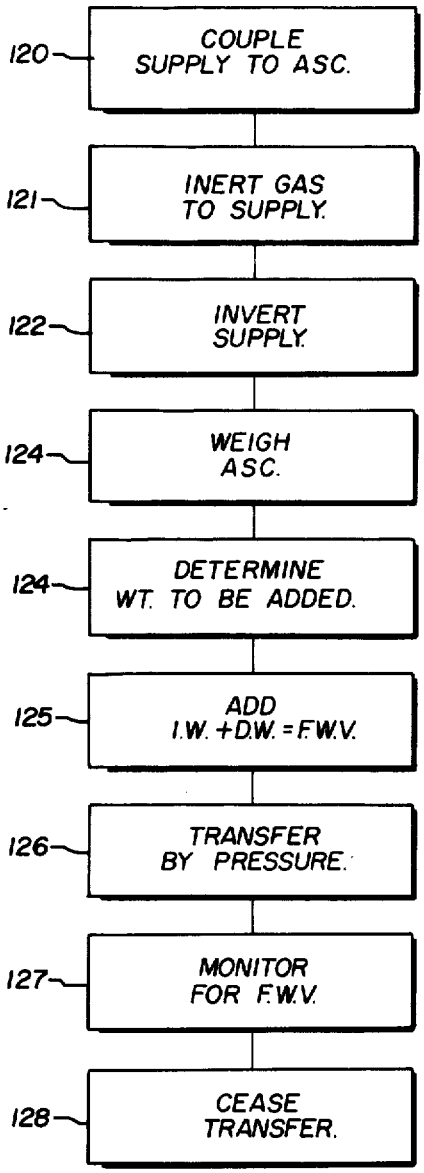
FIG. 16
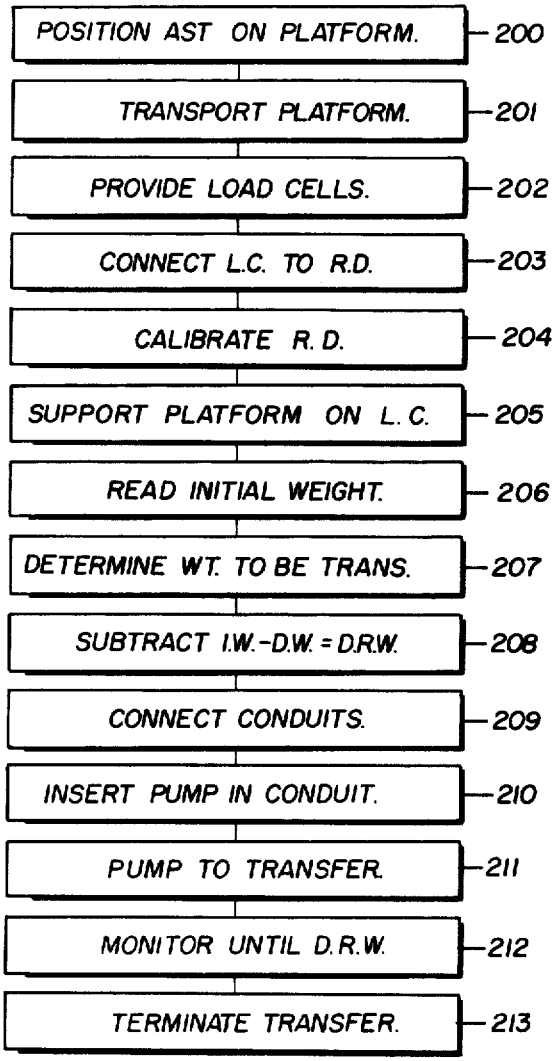

METHOD FOR CHARGING A FIRE PROTECTION SYSTEM

BACKGROUND OF THE INVENTION

1. Field of the Invention

This invention relates generally to an improved method for charging and recharging a fire protection system and more particularly to an improved method for charging and recharging an agent storage container with a predetermined mass of fluid fire-extinguishing agent or suppressant or even with a test fluid such as Freon 12.

2. Description of the Prior Art

The need for fire protection systems has been recognized for many years. A first major breakthrough was the development of the automatic sprinkler systems which are still used in many applications today, but the development of new technology using new materials and new power sources has created an immediate demand for more sophisticated fire protection systems. Many areas of industry employ highly volatile or explosive materials so that today's fires could be far more destructive than those of the past. Additionally, a growing concern for employee safety; the value of equipment or materials stored in a high value area; and the enormous increase in the costs attributable to the time lost while access to a given area or piece of equipment is denied have combined to create a critical demand for more sophisticated fire protection systems capable of quickly detecting a start of a fire or deflagration and immediately reacting to suppress or extinguish the combustion.

Many types of more efficient fire prevention or suppression systems have been developed using carbon dioxide, nitrous oxide, or bromotrifluoromethane ($CBrF_3$) which is frequently referred to as "FREON FE1301", "HALON 1301" or simply "HALON". The most effective of these systems today would appear to be those employing HALON since they have the advantage of an extremely fast reaction time, no aftermess, and no damage to equipment or personnel.

The individual fire-extinguishing containers, referred to in the art as agent storage containers, are installed at strategic locations in or about the area to be protected. When a fire or rapid combustion is detected by means of smoke detectors, heat sensors, optical or pressure detectors or the like, the agent storage containers are discharged such that fluid through their nozzles immediately extinguishes the fire by either a total flooding or a local application technique. The modular HALON systems require little or no piping, can be installed in relatively inexcessible strategic locations, and employ an extremely safe and effective fire-extinguishing agent. The agent has exceptionally low toxicity so that it is not harmful to human beings and it quickly vaporizes to leave no residue after the fire has been extinguished. It is non-corrosive and does not attack or react with normal construction materials or equipment components and will not damage delicate electrical or electronic equipment or the various types of record materials often found in high value areas.

The installation of such systems becomes a necessity in many high value areas such as computer rooms, bank vaults and other areas where valuable materials or equipment are stored or where the loss of access to the area could result in millions of dollars worth of damages. Many such systems have been installed and the major service problem encountered arises from the fact that the agent storage containers must be charged with a predetermined mass of fire-extinguishing agent such as HALON. For most effective use, the amount of agent mass stored in each and every agent storage container must be measured within a relatively precise range. Each agent storage container must be charged and recharged after having been used on an individual basis. In areas where the containers are situated in relatively inaccessible, hard-to-reach locations, the charging or re-charging operations are quite time-consuming, relatively expensive, and often hazardous.

The method used for charging and re-charging the agent storage containers prior to this invention involved physically removing the agent storage container from its remote location, computing the equivalent weight of the predetermined mass of fire-extinguishing agent which the container is designed to receive, and then placing the uncharged container on a scale or similar weighing device of sufficient accuracy. A supply cylinder containing the fluid fire-extinguishing agent is then moved as close to the site as possible; inverted, and secured to a tilt rack. A conduit such as a pipe, tube, hose or the like is connected between the outlet valve of the inverted supply cylinder and the inlet valve of the agent storage container and a fluid transfer pump is connected in the conduit to transfer the agent from the supply cylinder to the fluid storage container. The initial weight of the agent storage container is recorded and fluid is transferred via the pump until the scale indicates that the equivalent weight corresponding to the predetermined mass had been transferred. At the completion of this transfer, the inlet valve to the agent storage container is closed to terminate the transfer and the laborious task of re-installing the fully-charged, relatively heavy agent storage container to its often relatively inaccessible remote location in the protected area was undertaken. This, of course, had to be repeated for each and every one of the agent storage containers located within the protected area and resulted in a time consuming operation which greatly increased the cost of installing and maintaining these systems.

The disadvantages of the prior art method of charging and re-charging the agent storage containers are eliminated by the present invention which greatly reduces the time required for the charging operation, provides alternate means for performing certain of the steps of the prior art and for combining certain steps into a single step and teaches alternate methods which may be particularly useful in specific applications. The prime embodiment of the present invention totally eliminates the need for removing the agent storage containers from the remote locations thereby greatly reducing the time required to charge or re-charge the containers and greatly lowering the overall cost of installing and maintaining the more sophisticated fire-extinguishing systems so much in demand today.

SUMMARY OF THE INVENTION

In the prime embodiment of the present invention, a method of charging or re-charging an agent storage container which may be located in a relatively inaccessible location in, near or at an area, room or piece of equipment to be protected with a fluid fire-extinguishing agent such as bromotrifluoromethane or the like from a supply cylinder apparatus. The supply cylinder apparatus is initially weighed and a determined as to the mass of fluid agent must be transferred from the supply cylinder to the container in order to establish a predetermined properly charged or filled state at the container is made. The determined mass is converted into an equivalent weight which is subtracted from the initial weight to arrive at a desired weight of the apparatus indicative of the fact that the determined mass has been transferred. The fluid agent is then transferred from the supply cylinder apparatus to the agent storage container while the continuously decreasing weight of the supply cylinder is monitored until the desired weight is obtained. The attainment of the desired weight indicates that the determined mass has been transferred to the container and the transfer of the fluid agent is then terminated.

The method of the prime embodiment may be preceded by the steps of inverting the supply cylinder, securing it in a tilt rack, and placing the supply cylinder and tilt rack on a scale of sufficient accuracy to measure the predetermined mass to be transferred. An alternate method may involve providing the supply cylinder with a syphon tube, standing the syphon tube equipped cylinder in an upright position, and placing the upright storage cylinder on a scale of sufficient accuracy for measuring the predetermined mass.

The determining step of the present invention is a subtractive process and involves recording the initial weight of the supply cylinder apparatus, usually with the fluid conduit connected between the outlet valve of the supply cylinder and the inlet valve of the agent storage container prefilled, ascertaining the equivalent precise weight of the predetermined mass of fluid agent which must be transferred to the container to achieve the properly charged or filled state, and then subtracting the equivalent weight from the initial weight to arrive at the desired weight at which transfer will be terminated.

The basic process may also be modified by preceding the transfer step with the step of inserting a fluid transfer unit, device or pump into a conduit which is connected between the supply cylinder and the container and then performing the transfer of agent from the cylinder to the container by pumping. In the alternative, a cylinder of inert gas such as nitrogen may be provided; the gas cylinder may be coupled to the supply cylinder; and then the supply cylinder pressurized with the inert gas to superpressurize the fluid and effect the transfer without the need of a transfer pump in the system. Of course, the superpressurization step may need to be repeated several times to effect the desired transfer as described below.

A variation on the prior art method which still involves removing the agent storage container from the remote location and then placing it on a scale includes the steps of providing a pressurized cylinder of inert gas such as nitrogen, supplying inert gas from the pressurized cylinder to superpressurize the agent supply cylinder, inverting the superpressurized supply cylinder and then, although eliminating the transfer pump, effecting the desired transfer to the agent storage container by the superpressurization within the supply cylinder alone. It may be necessary to interrupt the transfer, restore the supply cylinder to the upright position, again superpressurize it from the pressurized cylinder and re-invert it before continuing the transfer and this may be repeated as often as necessary until the desired predetermined mass has been transferred to the agent storage container.

Other embodiments of the present invention involve varying the above methods by positioning a first operator at the weighing device to monitor for the desired weight; positioning a second operator at the agent storage container to shut off the input valve; and establishing a communication link between the two operators for signaling when termination of transfer is to be made. Alternately, means could be provided to generate a signal when the desired transfer weight is attained; the inlet valve of the agent storage container could be provided with a signal-operated shut-off means; and the generated signal could be communicated to operate the shut-off means when termination is to be effected.

A further embodiment involves the use of a relatively large supply tank of fire-extinguishing agent such as bromotrifluoromethane and the method includes positioning the relatively large tank on a platform; transporting the platform to an operations site; providing a plurality of load cells capable of generating electrical signals indicative of the weight experienced by the load cells; connecting the load cells to a read-out device; calibrating the read-out device; supporting the platform on the load cells, reading the intial weight of the platform and the agent storage tank positioned thereon; determining the weight to be transferred to the agent storage container for proper fill conditions, subtracting the determined weight from the initial weight to arrive at a desired reduced weight; connecting conduits between a first output valve of the tank and the inlet valve of the agent storage container; inserting one or more fluid transfer pumps into the conduits; pumping the fluid to effect the transfer; monitoring the continually reducing weight until the desired reduced weight is obtained; and terminating the transfer upon the attainment of the desired reduced weight.

The present invention also provides a method and apparatus for hot or cold weather transfer from a typical large-volume supply tank wherein the heating or cooling apparatus is positioned externally of the tank itself and the heated or cooled agent is recirculated back to the tank until proper temperature conditions are attained.

The prime embodiment of the present invention totally eliminates the need for removing the agent storage containers from their remote locations in order to place them on weighing devices during the charging and re-charging operation. The present method allows the agent storage containers to be permanently positioned, to be positioned in relatively inaccessible areas, and to be retained in those areas even after they have discharged their contents and need to be recharged with fluid agent. The subtractive techniques of the prime embodiment requires only that the supply cylinder apparatus be positioned on the scale and that the mass which must be transferred to the storage container is known. Since the supply cylinder apparatus is placed on a scale and weighed in the subtractive technique of the present invention, it can be located at any convenient spot and does not need to be in the protected area or even in the same building. The agent storage containers can be initially installed in an empty state, making the job much easier since they are considerably lighter thus reducing installation time and costs. Since the agent storage containers need never be removed for recharging, the time savings involved in recharging greatly reduced the overall cost of operating the system and allows access to be made to previously inaccessible or unuseable areas. The agent storage containers of the present invention can, in fact, be located in unuseable areas in the ceiling or the floor with only the valves and discharge nozzles being accessible.

Should it be desired to transfer the fluid agent over long distances, more than one fluid transfer pump may be connected in series, in parallel, or in a parallel-series combination to increase transfer efficiency over great distances or with greater speed in terms of a greater number of pounds per minute of agent pumped.

The methods of the present invention make use of the inverted supply cylinder and tilt rack apparatus of the prior art but may also be used with an upright supply cylinder provided with a syphon tube or with the relatively large-volume supply tanks which result in even greater cost savings. This added flexibility further contributes to the commercial desirability of the present low-cost method.

In large tank applications, load cells may feed the weight indications to a read out device. A first operator may be stationed at the read out device while a second operator is stationed at a remote location which may be located at a considerable distance from the location of the tank. When the desired weight is reached, as observed on the read-out device by the first operator, the second operator can be instructed over a communication link to properly terminate the transfer. Alternatively, the first operator may be eliminated and the read out device located at the remote location for direct observation by a single operator who can terminate the transfer. Still alternatively, both operators can be eliminated and the transfer terminated electrically when the desired weight is reached. Yet further, a vehicle transporting a large-volume tank of fluid fire-extinguishing agent could itself be placed on a scale and a conduit coupled over a large distance with one or a plurality of fluid transfer pumps used to transport the agent to remote locations. Communication links could again be used to insure that the proper precise amount of predetermined mass is added to the agent storage container without over-fill or under-fill. Similarly, a large-volume tank could be placed on load cells carried on the back of a truck for even greater flexibility.

The many embodiments of the present invention and the many variations and modifications which may be made thereto result in an extremely flexible, low-cost, time-saving method and system for charging and recharging the agent storage containers of today's more sophisticated fire protection systems and render such systems feasible in many applications where they would heretofore have been economically or physically impractical.

BRIEF DESCRIPTION OF THE DRAWINGS

These and other objects and advantages of the present invention will become more readily apparent upon reading the following specification which describes illustrative embodiments of the present invention, along with the accompanying claims and the drawings in which:

FIG. 5 shows a schematic diagram of an alternate embodiment of the present invention wherein the transfer pump has been eliminated and a pressurized cylinder of inert gas has been substituted therefor;

FIG. 6 shows a series of transfer pumps inserted into a single conduit between a supply cylinder and the inlet valve of an agent storage container;

FIG. 7 shows another embodiment of the conduit connecting the supply cylinder to the agent storage container wherein two parallel paths are established, one of the paths containing two transfer pumps in series;

FIG. 8 shows a schematic illustration of the subtractive method of the present invention as used in a typical application;

FIG. 9 shows a schematic illustration of a large volume supply tank embodiment wherein load cells are used to supply weight information to a readout device;

FIG. 10 shows a broken away schematic diagram of a portion of FIG. 9 wherein a single operator is substituted for two operators and the read out device is provided at the remote location;

FIG. 11 shows another alternate embodiment of FIG. 9 wherein both operators are replaced with electrical means;

FIG. 12 illustrates an embodiment wherein a vehicle which carries the supply tank of FIG. 9 is itself positioned on a weight device to employ the subtractive technique of the present invention;

FIG. 13 shows a block diagram or flow diagram of the prime embodiment of the method of the present invention;

FIG. 15 is a block diagram of the additive technique wherein the transfer pump is replaced by a cylinder of inert gas;

FIG. 16 is a block diagram or flow diagram of the large volume supply tank/load cell/read-out device embodiment of the present invention;

DESCRIPTION OF THE PREFERRED EMBODIMENT

Many of today's highly sophisticated fire-suppression systems strategically position a plurality of agent storage containers in or about a high value or high danger area which is desired to be protected. Such units are often positioned in areas such as computer rooms wherein, while the damage to the equipment itself from a fire may run many hundreds of thousands of dollars, the down-time or loss of time during which the computer facility cannot be used may result in many millions of dollars of damage over relatively short periods of time. In the interests of the end user's requirements for esthetics or space limitations and the like, the agent storage containers of these systems are generally placed in relatively inaccessible or out-of-the-way places so they do not interfere with the normal work routine of the people operating the computers or other equipment. The modern chemicals used in these systems such as bromotrifluoromethane react instantly to suppress the fire, leave no residue, and will not harm the delicate electrical equipment.

These modern fire-extinguishing systems also find use in areas such as bank vaults, and in other storage areas such as tape libraries and the like wherein very important or high cost equipment or materials are stored; in dangerous areas such as chemical rooms employing aerosol sprays, or dip tanks, or the like, and in rooms for the preparation or testing of fuels or mixing of volatile or rapid burning materials and the like and other similar areas. While these systems have proven highly desirable for such use, widespread use has been restricted by the cost of such systems. A large part of that cost is attributable to the loss of time and direct cost required to charge and re-charge the system after it has been activated and discharged to suppress a fire. The present invention allows such fire-suppressing systems to be used anywhere, e.g., in homes, offices, hospitals, schools, factories and the like.

Figure 1:
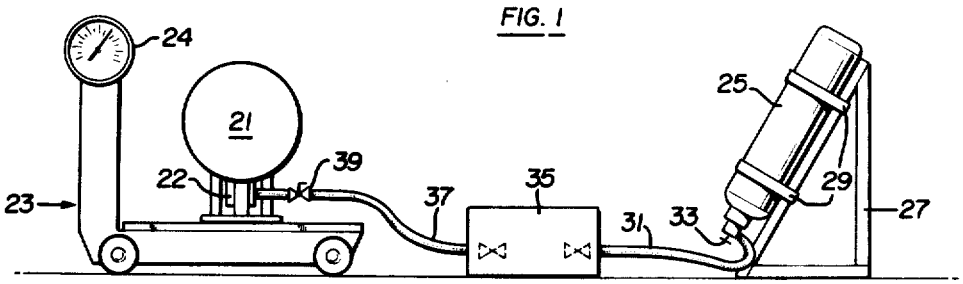
FIG. 1 is a schematic diagram of the prior art method of charging or recharging an agent storage container used in a fire suppression system.

The schematic diagram of FIG. 1 shows a prior art system for charging or re-charging an agent storage container 21. The agent storage containers 21 come in many different sizes, shapes and capacities and each agent storage container 21 may be equipped with many different types of valve assemblies 22. The agent storage container 21 is placed on a scale 23 or other weighing device having a read out dial 24, or similar means of indicating the weight of anything placed thereon. The weighing device 23 must be of sufficient capacity to measure the weight of a filled agent storage container 21 and the read out device 24 must be sufficiently accurate to determine the mass of fluid agent transferred to the container 21 with the required degree of precision. A supply cylinder 25 is inverted and placed in a tilt rack 27 and secured thereto by some type of fastening strap or chain 29 to insure that the supply cylinder 25 remains in the inverted position. A fluid conduit 31 is connected between the outlet valve 33 of the supply cylinder 25 and the input of a fluid transfer pump 35. The fluid transfer pump 35 may be any type of transfer unit known in the art such as model SC-5 transfer unit manufactured by Norris Industries; any of the suitable types of hydraulic pumps manufactured by SC Hydraulic Engineering Corporation or any other type of suitable, conventionally known fluid transfer unit, device or pump. The outlet of the fluid transfer pump 35 is connected via conduit 37 to the inlet fill valve 39 of the agent storage container 21.

In the prior art method of charging and recharging the agent storage container, the container 21 is removed from its remote location, a process of taking considerable time and effort and involving increased exposure to the safety hazards associated with pressurized systems; is carried to a location where the scale 23 can be positioned; and is then placed theren. The initial weight of the agent storage container 21 is then read and recorded from the indicator 24 of the scale 23. The weight of the predetermined mass of fluid fire-extinguishing agent which the container 21 is designed to hold would be converted into a weight equivalent, which is usually printed on the container 21 itself, and the final filled weight or fully-charged weight of the container 21 would be computed by adding the determined weight to the initial weight. The outlet valve 33 of the supply cylinder 25 would be opened, the inlet valve 39 of the agent storage container 21 would be opened and the pump 35 would be operated to transfer the fluid fire-extinguishing agent from the inverted supply cylinder 25 to the container 21. An operator, positioned near the weighing device 23, would observe the increasing weight of the agent storage container 21 on the indicator 24, and when the final fully-charged weight was achieved, he would shut off the inlet valve 39 to terminate the transfer of the fluid agent to the container 21. The agent storage container would then need to be disconnected from the conduit 37 and physically replaced at its remote location, a process involving considerable time, effort, expense and safety hazards.

Figure 2:
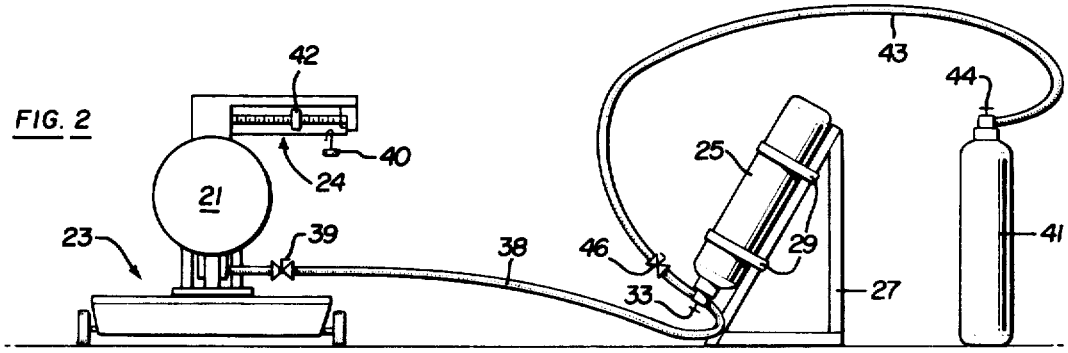
FIG. 2 is a schematic diagram of one embodiment of the present invention wherein the fluid transfer pump is eliminated and the additive technique of the prior art is used.

FIG. 2 represents a new variation of the additive method of the prior art wherein the relatively expensive fluid transfer pump 35 is eliminated. FIG. 2 shows an agent storage container 21 positioned on a weighing device 23, which is shown as being a highly accurate scale of a type well-known in the prior art wherein the indication of the weight is taken by observing the amount of weights 40 and the position of the indicator 42 for an accurate reading. The supply cylinder 25 is inverted and secured to the tilt rack 27 by the fastening means 29, as known in the art. The outlet valve 33 is connected via conduit 38 to the inlet valve 39 of the agent storage container 21. A high pressure cylinder 41 of inert gas, such as nitrogen or the like, has its outlet valve 44 connected to the inlet valve 46 of the supply cylinder 25 via conduit 43.

The method of the embodiment of FIG. 2 will be described with reference to the block or flow diagram of FIG. 15. As indicated by block 120, the supply cylinder 25 is coupled to the agent storage container 21 via outlet valve 33, conduit 38 and inlet fill valve 39. Block 121 then specifies that the cylinder 41 of inert gas is connected to the supply cylinder 25 and the inert gas is transferred to the supply cylinder 25 to superpressurize the fluid therein. Block 122 indicates that the supply cylinder 25 is then inverted, as shown in FIG. 2, by being placed in a tilt rack 27 and secured thereto by straps 29. Block 123 then requires that the agent storage container which has been physically removed from its remote location be placed on the scale 23 and its initial weight recorded. Block 124 indicates that the weight to be added to the agent storage container must be determined. Since a predetermined, relatively precise amount of mass is required to fully charge the agent storage container 21, the mass or its weight equivalent can be calculated or taken from records or written information printed on the container 21. The step set forth in block 125 indicates that the initial weight of the empty agent storage container 21 is then added to the equivalent weight of the predetermined mass to be added, which was determined in the step of block 124, to arrive at a final weight value. With the inlet pressure valve 46 closed and the outlet valve 33 opened, the pressure of the inert gas at the bottom of the cylinder 25 will transfer the fire-extinguishing fluid agent from the supply cylinder 25 to the agent storage container 21, as indicated by the step of block 126. Block 127 indicates that an operator would normally monitor the read out device 24 until he observed that the final weight value which was determined in the step of block 125 is obtained. At that point, the operator would shut off the fill valve 39 to terminate the transfer of fluid agent to the container 21 or otherwise cease transfer as required by block 128. The steps of blocks 121, 122 and 126 may have to be repeated until the determined weight is transferred.

Figure 3:
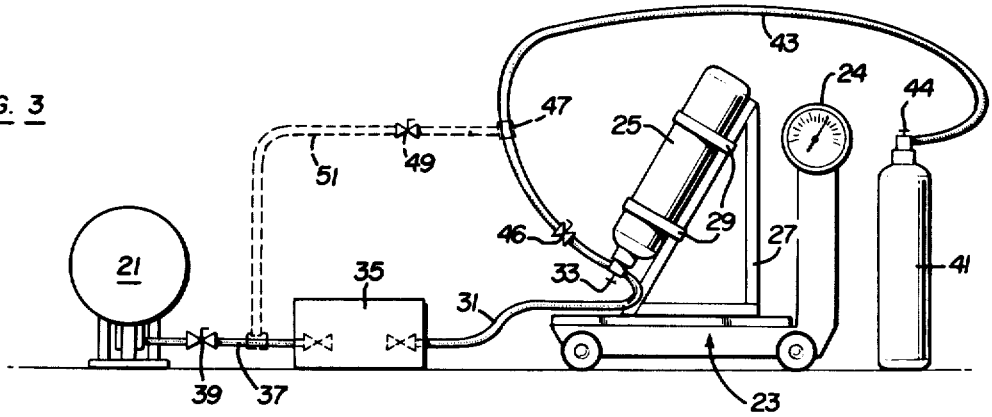
FIG. 3 is a schematic diagram illustrating the prime embodiment of the present invention with the subtractive technique being used and both a transfer pump or, alternatively, a pressurized cylinder of inert gas, being shown to illustrate variations thereof.

FIG. 3 illustrates a schematic diagram explaining the method of the prime embodiment of the present invention. The major advantage of this system resides in the fact that the agent storage container 21 does not have to be removed from its remote location. All that is required is that the conduit 37 be connected to the fill valve 39 regardless of the position or location of the agent storage container 21. In FIG. 3, a subtractive technique rather than an additive technique is used and the inverted supply cylinder 25 together with the tilt rack 27 to which it is secured by the fastening means 29 is placed on the weighing apparatus 23.

For the basic operation, reference is made to FIG. 13 which describes the basic method of the prime embodiment of the present invention. The step of block 129 requires that the supply cylinder 25, together with the tilt rack 27 be placed on the scale 23 and its initial weight recorded. The step of block 131 indicates that a determination is made as to the desired weight which represents the reduced weight recorded on the indicator 24 at which the operator would be able to conclude that a predetermined, relatively precise mass of fluid agent has been transferred from the cylinder 25 to the agent storage container 21. The step of block 133 indicates that the fluid free-extinguishing agent is transferred from the supply cylinder 25 to the agent storage container 21. Block 135 indicates that the indicator 24 of scale 23 is monitored until the desired weight determined in the step of block 131 is reached and block 137 indicates that transfer is terminated once the desired weight is attained. In the description of the method of FIG. 14, the steps of block 129, 131, 133, 135 and 137 will be referred to as basic steps A, B, C, D and E, respectively.

It will be noted that FIG. 3 is also shown to indicate various alternative methods which may be employed. A cylinder of inert gas 41 is connected by a conduit 43 to a T-shaped juncture 47 which is connected to the inlet supply valve 46 of the inverted cylinder 25 and to an alternate valve 49 which connects via alternate conduit 51, shown in phantom lines in FIG. 3, to the inlet valve 39 of the agent storage container 21. With the system of FIG. 3, the fluid agent contained within the inverted supply cylinder 25 could be superpressurized prior to transfer to the agent storage container 21 if the inlet valve 46 were opened and the alternate valve 49 were closed. In the alternative, valve 46 would normally be closed and valve 49 opened before or after the agent is transferred to superpressurize the agent within the agent storage container 21 as is normally required to achieve a properly charged state. Alternately, the gas used to superpressurize the agent storage container 21 could be supplied directly to the agent storage container 21 and the pressure measured before or after agent transfer by more direct methods.

Figure 4:
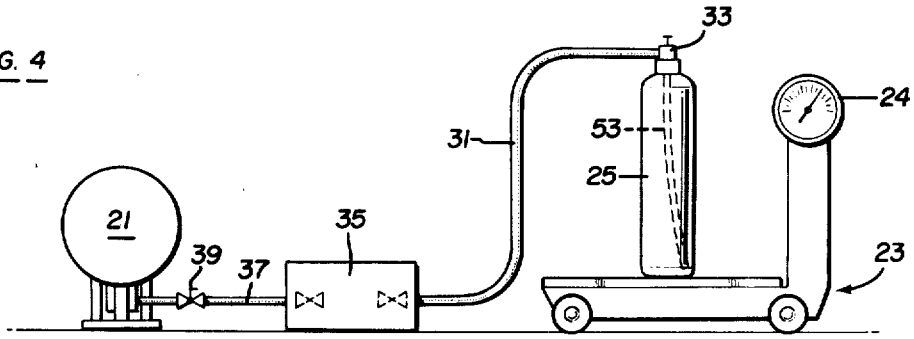
FIG. 4 shows a schematic diagram of an alternate embodiment of the present invention wherein an upright supply cylinder employing a syphon tube is used with the subtractive technique of the present invention.

FIG. 4 shows a schematic diagram of another alternate embodiment of the present invention whose method is described in FIG. 13 and it will be observed that the only difference from the system of FIG. 3 lies in the fact that the agent supply cylinder 25 is equipped with a syphon tube 53 and is placed in an upright position on the scale 23.

FIG. 5 shows still another alternate embodiment to the present invention whose method is described in FIG. 13, and it will be noted that the transfer pump 35 of FIG. 3 is totally eliminated. The cylinder of inert gas 41 has its outlet 44 connected via conduit 43 to the inlet valve 46 of the inverted supply cylinder 25. The inlet to the supply cylinder may be equipped with a pressure gage 55, if desired, to monitor the pressurization thereof. In this embodiment, the pressure of the inert gas is used to drive the fluid agent from the supply cylinder 25 into the agent storage container 21 to effect the transfer in place of the pump 35 employed in the alternative embodiment of FIGS. 3 and 4, as previously described.

Figure 14:
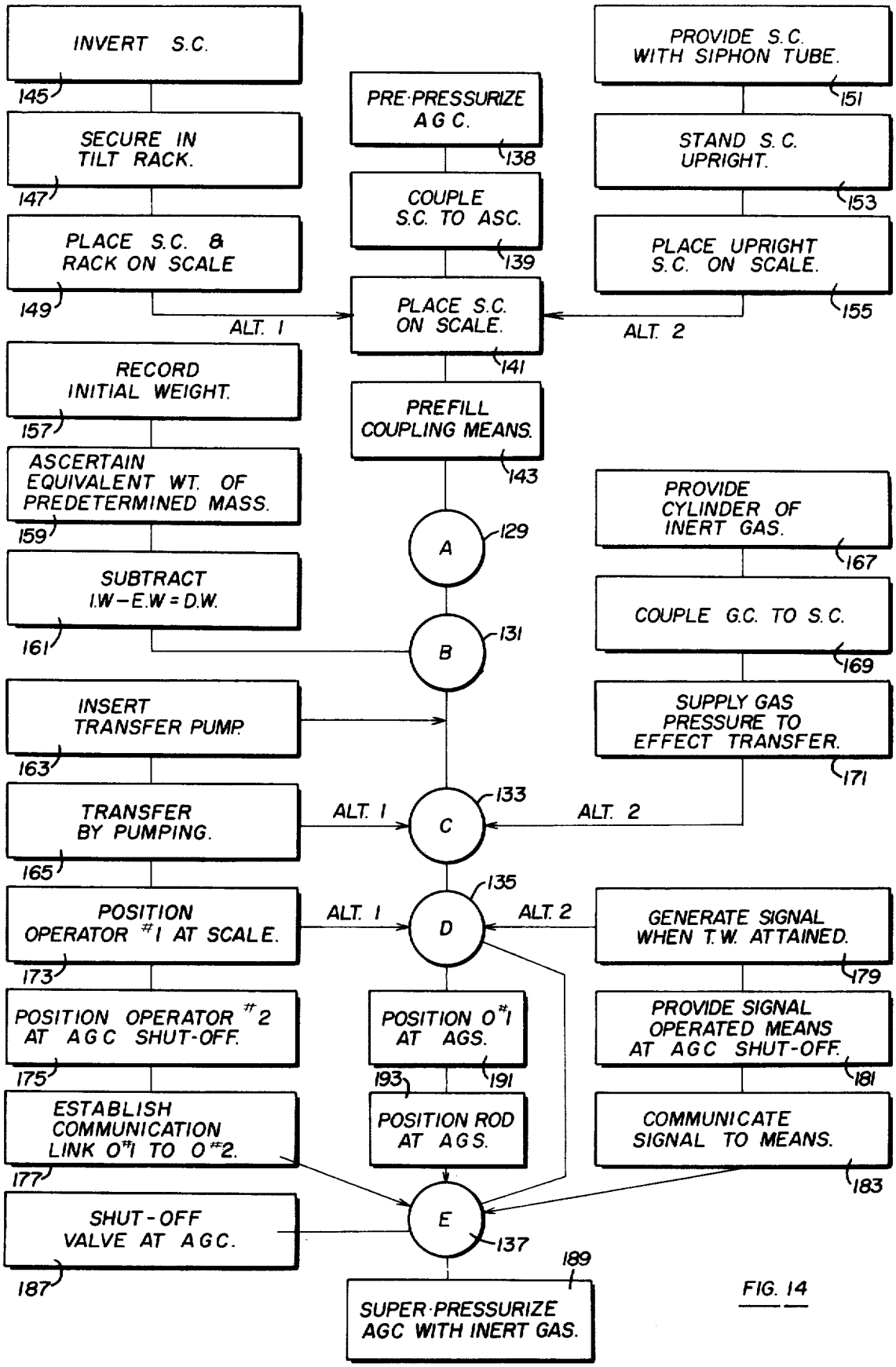
FIG. 14 shows the many modifications and variations which may be made to the basic method of FIG. 13 in block diagram or flow diagram form.

The various alternate methods or modifications shown in FIG. 14 represent alternative embodiments to the basic method of FIG. 13 and can be explained with reference to the apparatus of FIGS. 3, 4 and 5. As noted in FIG. 14, the basic steps of FIG. 13 are noted by the circles labeled A, B, C, D and E. The step of initially weighing which is represented by the circle A, may be preceded by the steps of blocks 139, 141 and 143. Block 139 represents the step of coupling the supply cylinder 25 to the agent storage container 21. Generally, this would represent physically connecting a fluid conduit therebetween. The step of block 141 represents placing the supply cylinder 25 onto the weighing device or scale 23 and the step of block 143 represents opening the outlet valves 33, 35 and 39 to prefill the coupling conduit for greater accuracy in future weight readings. Even before these steps, the initial step 138 of prepressurizing the agent storage container with a predetermined amount of inert gas may be performed. As indicated in FIG. 14, there are two alternative methods or sets of substeps involved in block 141. In the first alternative, represented by blocks 145, 147 and 149, the supply cylinder 25 is inverted as per the step of block 145; secured in the tilt rack 27 via fastening means 29 as per block 147; and then the inverted supply cylinder 25 and the tilt rack 27 is placed in the scale 23 as indicated by the block 149. The second alternative or set of substeps is represented by the blocks 151, 153 and 155. Block 151 indicates that the supply cylinder 25 is provided with a syphon tube 53, as indicated in FIG. 4. Block 153 indicates that the supply cylinder 25 which has been equipped with a syphon tube 53 is maintained upright and block 155 indicates that the syphon-tube equipped cylinder 25 is then placed in an upright position on the scale 23.

FIG. 14 also indicates the basic substeps which may be used in the determining step B which represents the step of block 131 of FIG. 13. These substeps set forth the subtractive process of the present invention and are represented by blocks 157, 159 and 161. In block 157, the initial weight of the supply cylinder apparatus 25 and the tilt rack assembly of FIG. 3 or the upright assembly of FIG. 4 is taken and recorded. Block 159 indicates that the equivalent weight of the predetermined mass of fluid agent which is to be transferred to the agent storage container 21 is ascertained by calculation, by looking it up in a suitable table, by reading it from information contained on the storage container itself or by some other suitable means. Block 161 represents the basic subtractive step itself, and in this step, the equivalent weight of the predetermined mass which is to be transferred which was ascertained in the step of block 159, is subtracted from the recorded initial weight of the apparatus which was taken in the step of block 157 and a desired weight is obtained.

Blocks 163 and 165 represent the first alternative form of the transfer step C with block 163 indicating that between the basic steps B and C, one or more transfer pumps may be inserted into the conduit between the supply cylinder 25 and the agent storage container 21. Block 165 then indicates that the actual transferring of step C is effected by operation of the inserted pumping devices. A second alternative to the transfer by pumping is indicated by blocks 167, 169 and 171. Block 165 indicates that a pressurized cylinder 41 of inert gas, such as nitrogen or the like, is provided and block 169 indicates that the outlet valve 44 of the gas cylinder 41 is coupled by a conduit 43 to the inlet valve 46 of the supply cylinder 25. Block 171 indicates that the inert gas of the cylinder 41 is supplied via the inlet valve 46 to the supply cylinder 25 to superpressurize the cylinder 25 to allow the pressure itself to effect the transfer of fluid agent from the cylinder 25 to the agent storage container 21 without the need for a pumping unit.

Various alternative paths may be followed from step D to step E as shown by the first alternate route including blocks 173, 175 and 177 or by the second alternative route comprising blocks 179, 181 and 183. The first alternative set of steps between the monitoring step block 135 and determination step of block 137 is generally depicted in the schematic diagram of FIG. 8. Block 173 involves the step of positioning a first operator 102 at a location from where he may observe the indicator 24 of scale 23 which holds the supply cylinder 25. Block 175 indicates that a second operator 103 is positioned at a remote location 63 whch may represent a high value area such as a computer room or the like. The second operator 103 is shown, in FIG. 8, standing on a ladder 71 to obtain access to the remotely-located agent storage container 21 so that he is able to control the shut-off valve 39. Block 177 indicates that a communication link 105 is established between the first operator 102 and the second operator 103 so that the first operator 102, who has a transmitting device 75, is able to advise the second operator 103, who has a receiver 77, that the desired weight has been obtained so as to enable the second operator 103 to immediately terminate the transfer by shutting off the inlet fill valve 39.

The second alternative means and sub-alternatives thereof will be described hereinafter. It will be observed that block 187 indicates that the termination step E may be effected manually or electrically by shutting off the fill valve 39 to terminate the transfer of agent from the cylinder 25 to the container 21 and block 189 indicates an alternative step which may be added after the termination step wherein the cylinder 41 of inert gas, such as nitrogen, is connected to the agent storage container 21 via outlet 44, conduit 43, intersection 47, valve 49, conduit 51 and valve 39 to superpressurize the agent storage container after it has been fully-charged, as shown in FIG. 3.

FIG. 6 indicates that the pumping efficiency or pumping power may be increased by inserting a plurality of transfer pumps 35 in series between the conduit 31 and the inlet valve 39. FIG. 7 indicates still another embodiment wherein a plurality of parallel paths are provided between the outlet conduit 31 and the inlet valve 39. In the first conduit path 57, only a single transfer pump 35 is inserted but in a second parallel conduit path 59, two fluid transfer pumps 35 are coupled in series. FIGS. 6 and 7 are meant to show that any number of fluid transfer pumps may be connected in series, in parallel, or in a parallel-series combination to effect the degree of pumping power or efficiency required for the transfer operation.

FIG. 9 illustrates a schematic diagram of an embodiment wherein a large-volume agent supply tank 79 is used. The unit or tank 79 may be a typical 2,000 pound shipping container frequently employed in the prior art to transfer fire-extinguishing agents such as bromotrifluoromethane (Halon). The typical tank 79 includes a first outlet valve 81 having a first syphon tube 83 coupled thereto and a second inlet-outlet valve 85 having a second syphon tube 87 coupled thereto. The tank 79 is typically adapted to be normally positioned on a longitudinal side and a liquid portion 89 would reside by gravity in the bottom of the tank in proximity to the first syphon tube 83. The tank 79 could be longitudinally positioned on a platform 91 adapted to retainably receive the tank 79 without allowing it to slide or roll therefrom. The platform 91 could be equipped with wheels 92 or otherwise equipped for transporting the platform 91 and the tank 79 positioned thereon from site to site, for example by the truck 119 shown in phantom lines in FIG. 9. Once at the desired site, the platform could be raised via jacks or the like and then lowered so that its only means of support would be on a plurality of load cells 93 which generate signals depending upon the load positioned thereon and transmit these signals via connectors 95 to node 97. Alternatively, the load cells 93 could support the platform 91 directly on the back of a truck 119. The node 97 could be connected via connective means 99 to a read out device 101 which could be, for example, a digital read out device or any of the types of devices known in the art for converting mechanical, pneumatic, hydraulic or electrical signals into a weight representation. A first operator 102 could be positioned by the read out device 101 to observe the weight indication produced thereby and a second operator 103 could be positioned at the remote area to be protected 63. A communication link 105 could be established between the first operator 102 and the second operator 103 and the operators could be provided with communication devices 107 such as audio headsets or the like so that the first operator 102 could advise the second operator 103 when the desired weight had been attained so that the second operator 103 could shut off the inlet valve 39 and terminate the transfer of fluid agent from the tank 79 to the agent storage container 21.

FIG. 10 represents an alternative embodiment of the method of FIG. 9 and it will be observed that the node 97 is itself connected via the electrical connection 99 to a read out device 101 which is located physically at the remote area to be protected 63. A single operator 103 is provided at the remote site 63 and is positioned such that he can directly observe the indication on the read out device 101. When the desired target weight has been attained, he will directly observe it on the read out device 101 and shut off the inlet valve 39 or otherwise effect a shut-down or bypass to terminate the transfer.

FIG. 11 shows still another alternate embodiment of the method of the system of FIGS. 9 and 10. The node 97 is connected via lead 99 to the read out device 101 and then the read out device 101 is connected via lead 109 to a signal-generating apparatus 111. The signal-generating apparatus 111 may be selected for any number of such apparatus in the prior art which is capable of reading an analog or digital representation of a weight, such as the attainment of a particular voltage threshold or the like and generating an electrical energization signal in response thereto. This energization signal is then supplied via electrical connection 112 to an electrically-operated valve control device 113. The electrically-operated valve control device may be a solenoid-controlled valve or some similar means, known in the art which is capable of responding to an electrical energization signal and closing the inlet valve 39 to terminate the transfer of fluid agent in the tank 79 to the agent storage container 21.

FIG. 12 represents schematically another alternate embodiment wherein the tank 79 is positioned on a platform 91 which rests on or is considered a part of a vehicle 119, such as a truck or the like. A transfer pump located on the truck 119 transfers the fluid agent via conduit 37 to a remote location in a building 115, as through a window 117 or the like. The truck 119, platform 91 and tank 79 apparatus is all positioned on the platform portion 118 of the scale 23 by driving the truck 119 up a ramp 120 or by some similar means of getting the vehicle 119 onto the scale platform 118.

Alternate paths between steps D and E of FIG. 14 may now be described. Blocks 179, 181 and 183 represents the embodiment of FIG. 11. In block 179, the threshold device 111 generates an energization signal in response to the attainment of the desired weight at the read out device 101. Block 181 requires that the inlet valve 39 be provided with an electrically-operated means for shutting off the valve in response to the energization signal, and block 183 represents the step of communicating the energization signal from the generator 111 to the valve control means 113 via electrical connection 112. A third alternative route between steps D and E could involve the embodiment of FIG. 10 and could be described with reference to blocks 191 and 193. Block 191 would represent positioning a single operator 103 at the remote area to be protected 63 and block 193 would represent positioning the read out device 101 proximate the single operator 103 at the remote site. When the operator 103 at the remote site observes on the read out device 101 that the target weight had been attained, he would terminate the transfer as per step E.

The method of the present invention for use with the large volume tank 79, the load cells 93, and the read out device 101 may be explained briefly with reference to FIG. 16 and the steps 200–212 depicted therein. The method involves positioning the relatively large volume agent storage tank 79 in the platform means 92; transporting the platform 91 to a site suitable for performing the transfer operation; providing a plurality of load cells 93, each of which is capable of generating an electrical signal indicative of the weight applied thereto; connecting the load cells to a read out device capable of summing the electrical signals from the individual load cells 93 and providing an indication indicative of the sum total of the load experienced by the load cells 93; calibrating the read out device to insure the accuracy of the measurement; supporting the platform 91 on the load cells 93 as by jacking up the platform 91, placing the load cells 93 thereunder; and lowering the platform to be solely supported only by the load cells 93; reading and recording the initial weight as indicated on the read out device 101; determining the amount of the weight of the predetermined mass required to be transferred to fully charge the agent storage device 21 at the remote location 63; subtracting the determined weight to be transferred from the initial weight recorded on the read out device 101 to determine a desired reduced weight; connecting a conduit between the outlet valve 81 and the inlet valve 39 of the agent storage container 21; inserting one or more transfer pumps 35 into the conduit between the tank 79 and the container 21; operating the pump or pumps 35 to transfer the agent from the tank 79 to the containers 21; monitoring the weight readings on the read out device 101 until the desired reduced weight is obtained; and terminating the transfer as soon as the desired read out weight is attained to insure that only the predetermined relatively precise mass of agent is transferred to properly charge the agent storage container 21.

Figure 17:
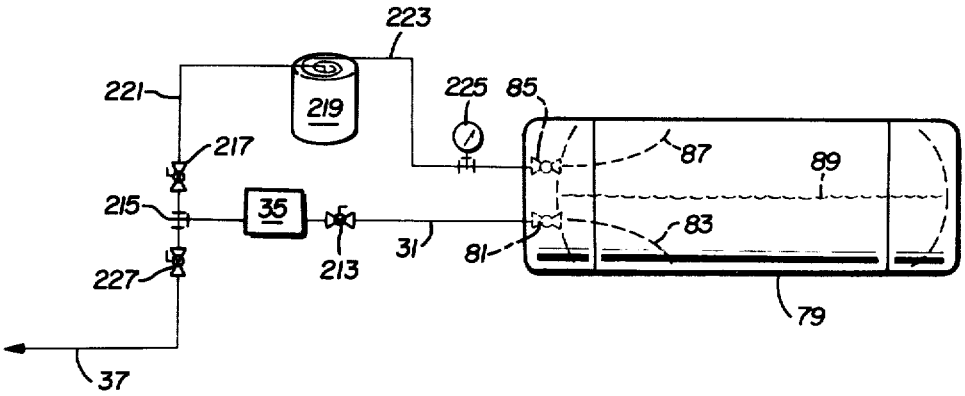
FIG. 17 shows a schematic diagram of a large supply tank pumping apparatus with an external heating means for cold weather operation.

FIG. 17 shows an apparatus employing an externally located heat exchanger means 219 for use with a large-volume shipping tank 79. In the apparatus of FIG. 17, the first or liquid outlet valve 81 is connected via conduit 31 to the inlet valve 213 of a fluid transfer pump 35 whose outlet is connected to a T-coupling 215. A first branch of the T-coupling 215 is connected to a return passage valve 217 which is coupled to the input of a heat exchanger 219 here operated as a heating means via a fluid transfer conduit 221. The heat exchanger means 219 may be a standard heat exchange device, an electrical heater or any type of conventionally known apparatus for heating fluid which is being circulated therethrough. The output of the heat exchanger 219 is connected via fluid conduit 223 through a pressure gage 225 to the second or inlet valve 85 to the tank 79. The other branch of the T-connection 215 connects to transfer valve 227 which opens or closes a fluid path to the agent storage container via conduit 37.

For cold weather operation, the agent transfer to the agent storage container 21 must be precisely controlled since its vapor pressure varies with temperature. It is, therefore, often desirable that the temperature of the fluid being transferred be maintained within predetermined limits. For cold weather pumping, therefore, the transfer valve 227 is initially closed and the return valve 217 is opened so that when the fluid transfer pump 35 operates, it transfers the liquid agent 89 from the tank 79 through the syphon tube 83 and valve 81 into the conduit 31 and through the valve 213 and pump 35 to the T-connection 215. From there the liquid agent 89 is transferred through the return valve 217 and conduit 221 to the heat exchanger 219 and has its temperature raised while passing therethrough. The heated fluid passes through the conduit 223 and valve 85 to return to the tank and slightly raise the temperature of the liquid 89 therein. This operation continues to recycle the liquid 89 from the tank 79 through the pump 35 and heat exchanger 219 to return it to the tank 79 until the temperature and/or pressure of the liquid agent 89 is within the proper range. At this time, the return valve 217 may be closed and the transfer valve 227 opened so that the fluid agent 89 may be transferred to the agent storage container 21 as per any of the methods previously described. Alternately, just valve 227 could be opened to allow transfer while recirculating a portion for continuous heating.

Figure 18:
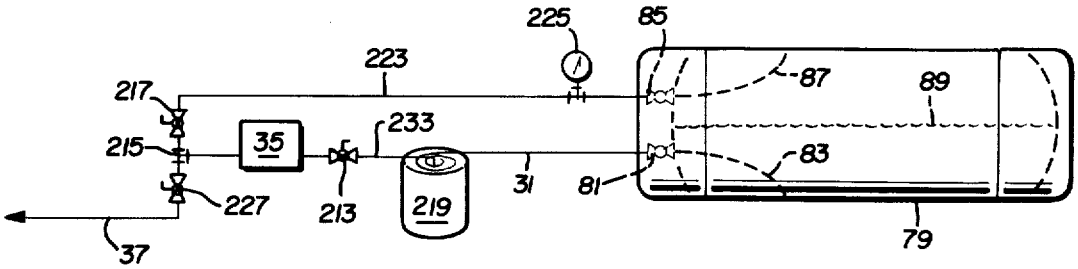
FIG. 18 shows a schematic diagram of a large supply tank pumping apparatus with an external cooling means for hot weather operation.

The temperature may also be critical during hot weather pumping and hence the apparatus of FIG. 18 is provided to externally cool the liquid 89. The outlet valve 81 is connected to the input of a cooling means or cooling apparatus 219 through a fluid conduit 231. The heat exchanger 219 may be any type of conventionally known apparatus which can cool a liquid or fluid agent passing therethrough. The cooled agent exits the heat exchanger 219 and flows through conduit 233 to the inlet valve 213 of a pump 35 and thence to the T-connection 215, previously described. The return valve 217 is connected to the tank inlet valve 85 via fluid conduit 223. In operation, the return valve 227 is closed. The pump 35 is then operated to transfer the liquid agent 89 from the tank 79 and through the heat exchanger 219. The cooled fluid agent then passes through the pump 35 and through the T-conduit 215 to return via path 223 and inlet valve 85 to the tank 79 to cool the liquid 89 contained therein. The pump 35 will continue to transfer the agent 89 through the cooling apparatus 29 and return it via conduit 223 to the tank until the temperature of the agent 89 is within the proper range. At that time, the return valve 217 may be closed and the transfer valve 227 opened so that the pump 35 can be operated to continually transfer the agent to the agent storage container 21 by the method previously described.

While several different methods have been described for transferring a predetermined mass of fire-extinguishing agent from a storage cylinder to an agent storage container at a remote location, it will be obvious to those skilled in the art that various modifications can be made within the various steps and alternate apparatus can be substituted for carrying out the various steps without departing from the spirit and scope of the present invention which is limited only the the appended claims.

I claim:

1. A method of charging or recharging an agent storage container with a fluid fire-extinguishing agent from a supply cylinder apparatus comprising the steps of:

initially weighing the supply cylinder apparatus;

determining the mass of fluid agent which must be transferred from said apparatus to said container to establish a predetermined properly charged state at said container and the desired weight of said apparatus when said determined mass of fluid agent has been transferred from said apparatus;

transferring said fluid agent from said apparatus to said container while simultaneously monitoring the decreasing weight of said apparatus as said agent is transferred therefrom until said desired weight is attained indicating that said determined mass has been transferred to said container; and terminating the transfer of fluid agent when said desired weight is attained.

2. The method of claim 1 further characterized in that said step of initially weighing is preceded by the steps of coupling the outlet valve of said supply cylinder apparatus to the inlet valve of said agent storage container, placing said supply cylinder apparatus on a weighing device suitable to the desired degree of accuracy required, opening said outlet valve and closing said inlet valve to prefill said coupling means with said fluid agent before weighing.

3. The method of claim 2 further characterized in that said terminating step includes turning off said inlet valve to prevent the further transfer of fluid agent into said container.

4. The method of claim 2 further characterized in that said determining step includes the steps of recording the initial weight of said supply cylinder apparatus with said coupling means filled with said fluid agent, ascertaining the weight equivalent of the determined mass which must be transferred to said container to establish said predetermined properly charged state, and subtracting said weight equivalent from said initial weight to determine said desired weight at which the transfer is to be terminated.

5. The method of claim 4 further characterized in that said fire-extinguishing agent is bromotrifluoromethane, said agent storage container is remote from said supply cylinder apparatus, and said coupling step involves connecting a fluid conduit from said outlet valve over a substantial distance to the inlet valve at said remote location.

6. The method of claim 4 further characterized in that said placing step includes inverting said supply cylinder such that the outlet valve end is generally oriented downwardly, securing said inverted cylinder in a tilt rack, and placing the rack on a platform scale of sufficient accuracy for weighing.

7. The method of claim 6 further characterized in that said coupling step includes connecting a fluid conduit between said outlet valve and said inlet valve and said method additionally includes inserting a fluid transfer pump into said fluid conduit intermediate said valves for transferring said fluid agent.

8. The method of claim 6 further characterized in that said coupling step includes providing a plurality of parallel conduit paths between said outlet valve and said inlet valve and said method further includes inserting a fluid transfer pump in each of said parallel conduit paths for greater pumping power in transferring said agent.

9. The method of claim 5 further including the step of providing a first operator at said weighing device and a second operator at the remote location of said agent storage container, establishing a communications link between said operators, said terminating step involving said first operator observing the attainment of said desired weight and advising said second operator thereof over said communications link and said second operator responding by turning off said inlet valve.

10. The method of claim 6 further characterized in that said container is located at a remote location a substantial distance from said apparatus, said coupling step includes connecting a fluid conduit between said outlet valve and said inlet valve and said method further includes inserting a plurality of fluid transfer pumps in series along said fluid conduit to boost the pumping potential of the system.

11. The method of claim 4 further characterized in that said fluid fire-extinguishing agent is bromotrifluoromethane and said method includes the additional step of superpressurizing the agent storage container to within a predetermined range of pressures.

12. The method of claim 6 further characterized in that said transfer step includes providing a pressurized cylinder of inert gas and coupling the outlet valve of the pressurized cylinder to the supply cylinder apparatus to effect the transfer of the fluid agent to the container.

13. The method of claim 12 further characterized in that said fluid fire-extinguishing agent is bromotrifluoromethane, said inert gas is nitrogen, said gas cylinder coupling step includes connecting a fluid conduit between the outlet valve of said pressurized cylinder and the outlet valve end of said supply cylinder apparatus, and opening the outlet valve of said pressurized nitrogen cylinder to enable said nitrogen gas to drive said agent into said agent storage container while simultaneously superpressurizing said agent.

14. The method of claim 4 further characterized in that said supply cylinder is provided with a siphon tube terminating at said outlet valve and said placing step includes standing said supply cylinder in an upright position upon a platform scale.

15. The method of claim 14 further characterized in that said coupling step includes connecting a fluid conduit between the upright outlet valve of said supply cylinder and the inlet valve of said agent storage container and said method further includes the step of inserting at least one fluid transfer pump in said fluid conduit for transferring said fluid agent.

16. The method of claim 4 further characterized in that said inlet valve at said agent storage container is electrically controlled and said monitoring step includes generating an electrical signal indicative of the attainment of said desired weight and transferring said signal to said electrically controlled valve for shutting it off in response thereto in said terminating step.

17. A method of charging and recharging an agent storage container apparatus with a fire-extinguishing agent from a portable agent supply unit comprising the steps of:

coupling a hose assembly between the outlet valve of the agent supply unit to the inlet charging valve of the agent storage container apparatus;

supplying a pressurized inert gas into the vapor space valve of the agent supply unit to pressurize the fire-extinguishing agent and simultaneously serve as the motive force to drive the liquid through the hose assembly;

inverting the agent supply unit to provide a supply of liquid fire-extinguishing agent to said outlet valve;

initially weighing the agent storage container assembly with the hose assembly filled;

determining the weight of pressuried fire extinguishing agent which must be added to the agent storage container assembly to attain a predetermined fully charged state;

adding the determined weight to the initial weight to obtain a final weight value indicating that the predetermined fully-charged state has been attained;

opening the inlet charging valve to admit pressurized fire-extinguishing agent into the agent storage container assembly;

monitoring the running weight of the agent storage container until said final weight value is attained; and closing the inlet charging valve to cease transfer and prevent overfilling in response to the attainment of said final weight value.

18. The method of claim 17 further characterized in that said fire extinguishing agent is bromotrifluoromethane, said inert pressurizing gas is nitrogen, said agent supply unit is an elongated pressure cylinder, said step of inverting includes placing said cylinder in a tilt rack such that said liquid agent flows toward said outlet valve by gravity and said step of initially weighing is preceded by the additional step of placing said agent storage container assembly on a relatively accurate and portable weighing apparatus.

19. A method of charging a remotely located agent storage container with a predetermined mass of fluid fire-extinguishing agent from a relatively large agent shipping tank weighing at least 150 pounds when filled, said tank having a first internal siphon tube communicating with a first fluid outlet valve and a second internal siphon tube communicating with a second fluid outlet valve, said method comprising the steps of:

retainably positioning said agent shipping tank on a transportable platform;

transporting said platform and the tank positioned thereon to a site from which said remote location is accessible;

providing a plurality of load cells which generate output signals in proportion to the weight placed thereon;

connecting the output signals of the load cells to a read out device to convert said signals to a weight reading;

calibrating said read out device to a zero reading when no weight is applied to said load cells;

supporting said transported platform solely on said load cells;

reading the initial weight of the platform and tank assembly;

determining the weight of said predetermined mass which must be transferred to said agent storage container to properly charge the same;

subtracting said determined weight from said initial weight to ascertain the desired reduced weight of said platform and tank assembly indicating that said predetermined mass has been transferred to said agent storage container;

connecting a fluid conduit means between said first fluid outlet valve and the inlet to said agent storage container;

inserting at least one fluid transfer pump into said fluid conduit means;

pumping to transfer said fluid agent from said agent shipping tank to said agent storage container;

monitoring the read out device until said desired reduced weight of said platform and tank assembly is attained; and terminating agent transfer in response thereto.

20. The method of claim 19 further characterized in that said fluid fire-extinguishing agent is bromotrifluoromethane and said remote location is often relatively inaccessible and spaced a substantially great distance from said tank.

21. The method of claim 19 further characterized in that said read out device is located physically closer to said tank than to said remote location, the method further includes the steps of positioning a first operator at said read out device for monitoring the weights indicated thereby and a second operator at said remote location to shut off the inlet valve to said agent storage container in response to a command from said first operator to effect said termination step and establishing a communication link between said operators to transmit said command from said first to said second operator when said first operator observes that said desired reduced weight has been attained.

22. The method of claim 19 further characterized in that said read out device is portable and carried by an operator stationed at said remote location for turning off the inlet valve to said agent storage container when the operator observes the attainment of said desired reduced weight.

23. The method of claim 19 further characterized in that the inlet valve on said agent storage container is electrically controlled to shut off in response to a command signal to effect said terminating step and said read out device generates said command signal in response to the attainment of said desired reduced weight to effect said monitoring step and said method additionally includes the step of communicating said generated command signal to said electrically controlled inlet valve when it is generated.

24. The method of claim 20 further characterized in that a plurality of said fluid transfer pumps are inserted into said fluid conduit means in series to increase the effectiveness of said pumping step.

25. The method of claim 20 further characterized in that said step of connecting includes connecting a plurality of fluid conduits in parallel between said first outlet and said inlet and said inserting step includes inserting at least one pump into each parallel conduit for greater pumping efficiency.

26. The method of claim 19 further characterized in that for cold weather transfers, said method includes the step of externally heating the agent outside of the tank.

27. The method of claim 26 further characterized in that said step of externally heating said agent includes pumping the agent out of the tank, circulating the agent to a device for heating the agent, and returning the heated agent to the tank.

28. The method of claim 26 further characterized in that said connecting, inserting, pumping and heating steps include the steps of connecting a first fluid conduit between said first outlet valve and the inlet of said pump, connecting the outlet of said pump to a coupling device having first and second coupling outlets, providing first and second direction control valves for said first and second coupling outlets, respectively, connecting said first direction control valve to the inlet valve of said agent storage container, providing an electrical heating unit external to said tank, connecting said second direction control valve to the input to said heating unit, connecting the output of said heating unit to the second outlet of said tank, closing said first direction control valve and opening said first direction control valve, pumping said agent to circulate it through said heating unit and back to said tank until a suitable temperature is attained and then reversing said first and second direction control valves to transfer heated agent to said agent storage container.

29. The method of claim 19 further characterized in that for hot weather transfers, said method includes the step of externally cooling the fluid agent outside of the tank.

30. The method of claim 29 further characterized in that said step of externally cooling said agent includes providing a cooling unit outside of said tank, pumping said fluid agent out of the tank, through the cooling unit and through the pump, and returning the cooled fluid agent back into the tank.

31. The method of claim 29 further characterized in that said steps of connecting, inserting, pumping and cooling include the steps of connecting the first outlet of said tank to the inlet to said cooling unit, connecting the outlet of said cooling unit to the input of the pump, connecting the output of the pump to first and second direction control valves, connecting the first direction control valve to the inlet valve of the agent storage container, connecting the second direction control valve to the second outlet of said tank, opening said second and closing said first direction control valves, pumping said fluid agent out of said tank and into said cooling unit, cooling said pumped agent, pumping the cooled agent back to the tank until a proper temperature is attained, and then reversing said first and second direction control valves to transfer said cooled fluid agent to the agent storage container.

32. The method of claim 19 further characterized in that said transportable platform includes a motor vehicle, which is driven to said site and said step of supporting includes jacking up said motor vehicle, placing said load cells in a position to support said vehicle, and lowering the jack to leave the vehicle solely supported on the load cells.

33. The method of claim 19 further characterized in that said step of providing a plurality of load cells includes placing said load cells on the back of a vehicle, said step of retainably positioning further includes mounting the platform in an operable position with respect to the load cells, and said transporting step includes driving the vehicle to the site.

34. An apparatus for charging and recharging an agent storage container having a fill valve with a predetermined mass of bromotrifluoromethane fire-extinguishing agent under relatively low temperature conditions comprising, in combination:

a large capacity, relatively heavy weight shipping supply tank containing a substantial mass of said fluid agent, said tank having first and second siphon tubes within said tank, said tubes exiting said tank and terminating in first and second control valves, respectively, said tank being adapted to lie on its side with at least said first siphon tube extending into the liquid portion of said fluid agent;

a fluid transfer pump coupled to said first control valve for pumping liquid agent therefrom;

valve means at the output of said pump for diverting the pumped liquid agent into a selected one of first and second fluid conduits, the selection of said first conduit supplying the pumped agent to the fill valve of said agent storage container;

a fluid heating means external to said tank, the selection of said second conduit supplying the pumped agent to said heating means for increasing the temperature thereof; and conduit means coupling the output of the heating means to the second control valve for returning heated fluid agent to said tank to increase the overall temperature thereof.

35. An apparatus for charging and recharging an agent storage container having a fill valve and adapted for use as a fire-extinguisher with a predetermined mass of bromotrifluoromethane fire-extinguishing agent under relatively high temperature conditions comprising, in combination:

a standard one ton shipping supply tank of said agent, said tank having a first and second siphon tube communicating the interior of said tank with corresponding first and second control valves;

a fluid cooling unit coupled to said first control valve;

a fluid transfer pump having its input coupled to the output of said cooling unit for pumping fluid agent from said tank and through said cooling unit;

valve means coupled to the output of said pump for selecting a first fluid path to supply the pumped agent to the fill valve of said agent storage container and a second fluid path coupled to the second control valve of said tank for returning the cooled fluid agent to the tank to lower the temperature of the agent therein.

36. In a system wherein relatively high value areas of buildings and the like are protected from fire by a plurality of agent storage containers located at suitable locations about the protected area, each of said containers requiring a relatively precise predetermined mass of fire-extinguishing agent to be contained therein, a method of charging and recharging said containers with said precise predetermined mass of agent from an agent supply cylinder comprising the steps of:

coupling said supply cylinder to one of said containers through a fluid transfer pump;

initially weighing said supply cylinder;

transferring said agent from said cylinder to said container;

monitoring the decreasing weight of said cylinder until said precise predetermined mass has been removed therefrom; and stopping the transfer of agent to said container when said predetermined mass has been pumped from the cylinder.

37. The method of claim 36 further characterized in that said fluid agent is bromotrifluoromethane and said step of initially weighing is preceded by steps of filling the coupling means with said agent, inverting said supply cylinder, securing said inverted cylinder to a tilt rack to maintain said inverted position, and placing said tilt rack and inverted supply cylinder on a weighing device of sufficient range and accuracy, and said monitoring step includes determining the desired reduced weight of said cylinder indicative of the fact that said predetermined mass has been transferred by converting the predetermined mass into a weight equivalent and subtracting said weight equivalent from said initial weight to compute said desired reduced weight.

38. The method of claim 36 further characterized in that said fluid fire-extinguishing agent is bromotrifluoromethane and said step of initially weighing is preceded by the steps of filling the coupling means with fluid agent to insure accurate transfers, providing said cylinder with a siphon tube, and placing said cylinder in an upright position on a weighing apparatus suitable to the degree of accuracy required, and wherein said monitoring step includes calculating the weight of the predetermined mass to be transferred, subtracting said calculated weight from the initial weight to determine a desired weight indicative of the transfer of said predetermined mass and continually observing the reducing weight until said desired weight is reached.

39. In a system wherein relatively high value areas such as computer rooms and the like are protected from fire and rapid burning materials by a plurality of agent storage containers located at suitable positions about the protected area, each of said containers requiring a relatively precise predetermined mass of fire-suppressing agent to be properly charged, a method of charging and recharging such containers with said predetermined precise mass of fluid agent such as bromotrifluoromethane from a fluid agent supply cylinder comprising the steps of:

coupling a first fluid valve at the outlet end of said cylinder to the inlet valve of said agent storage container;

coupling a second fluid valve on said inverted cylinder to a pressurized cylinder of inert gas;

closing said first fluid valve and opening said second fluid valve to pressurize said supply cylinder with said inert gas;

inverting said supply cylinder and placing said inverted agent supply cylinder on a weighing apparatus of sufficient accuracy;

initially weighing said inverted supply cylinder;

calculating the weight of the precise predetermined mass of fluid agent with must be transferred to insure a proper charge;

subtracting the calculated weight from the initial weight to ascertain a desired weight;

closing said second fluid valve and opening said first fluid valve to utilize the pressurized inert gas contained therein to transfer the fluid agent to the agent storage container;

monitoring the weight of the supply cylinder until said desired weight is reached; and terminating agent transfer in response to the attainment of said desired weight.

* * * * *